United States Patent [19]

Wright et al.

[11] Patent Number: 4,893,560

[45] Date of Patent: Jan. 16, 1990

[54] DOCUMENT AND CARD POSITIONING DEVICE FOR ROLLER IMPRINTER

[76] Inventors: A. Glenn Wright, Route 4, Box 355, Pittsboro, N.C. 27312; James L. Ross, 1803 Fountain Ridge Road, Chapel Hill, N.C. 27514

[21] Appl. No.: 249,908

[22] Filed: Sep. 27, 1988

[51] Int. Cl.[4] ..... B41F 3/04

[52] U.S. Cl. ..... 101/269; 101/45

[58] Field of Search ..... 101/268, 269, 378, 382, 101/329, 45

[56] References Cited

U.S. PATENT DOCUMENTS

| | | | |
|---|---|---|---|
| 2,039,072 | 4/1936 | Dugdale | 101/269 |
| 2,596,864 | 5/1952 | Penker | 101/269 |
| 3,277,822 | 10/1966 | Maul et al. | 101/269 |
| 3,610,148 | 10/1971 | Penaluna | 101/269 |
| 3,818,828 | 6/1974 | Nakada et al. | 101/269 |
| 4,024,816 | 5/1977 | Williams | 101/269 |
| 4,043,263 | 8/1977 | Nakada | 101/269 |
| 4,401,029 | 8/1983 | Barbour | 101/269 |
| 4,408,523 | 10/1983 | Senyitko | 101/269 |
| 4,418,619 | 12/1983 | Diel | 101/269 |

*Primary Examiner*—E. Eickholt

*Attorney, Agent, or Firm*—Lynn E. Barber

[57] ABSTRACT

A card and form positioning device for easy and accurate alignment of the embossed area of a plastic card with the appropriate area of a form that is to be imprinted. The device has an L-shaped piece and pegs protruding upward from a flat guide base and through the platen of a card imprinting machine. A spring means beneath the guide base pushes the pegs through holes in the platen. During imprinting, the roller mechanism strikes the L-shaped piece prior to moving across the pegs and causes the base and pegs to move downward so that the roller can imprint the form.

10 Claims, 4 Drawing Sheets

DOCUMENT AND CARD POSITIONING DEVICE FOR ROLLER IMPRINTER

BACKGROUND OF THE INVENTION

1. Field of the Invention

This invention relates to a card and document positioning device for use with an imprinter having a roller imprinting mechanism and in particular, to a device that utilizes a spring mechanism and pegs to enable positioning either of cards having printing on the bottom or top of the card face or of small size cards at the appropriate place for imprinting various sizes of forms.

2. Related Applications

This application relates to co-pending application Ser. No. 155,216, filed Feb. 12, 1988, entitled "DOCUMENT AND CARD POSITIONING DEVICE".

3. Description of the Related Art

Many organizations that deal with the public utilize plastic identification cards having the name of the customer, client or patient embossed on the face of the cards to imprint the identification information on invoices, order forms or other informational forms. Particularly in large institutions such as hospitals, although each embossing machine is generally used on only one type of card, more than one card size may be used in various parts of the institution on a variety of different sizes of forms. In addition, cards having the embossed information on the top or the bottom may be used in a particular institutional location to imprint the various sizes of forms.

There are three standard card styles that are often used in institutions such as hospitals. Two of these employ the standard credit card size, known as CR 80, which may be embossed either at the top or bottom of the card. The other card size, known as CR 50, is of a similar width as the CR 80 card but is not as large from top to bottom of the face of the card. The CR 50 card may be cut from a card the size of a CR 80 card with one portion of the CR 80-size card being used for a patient arm band and the other portion that is the size of a CR 50 card being used for patient identification cards to imprint forms. A preformed plastic product for this latter use is made by Bio-Logics Products, Inc. (West Jordon, Utah).

A number of different embossing machines have been developed commercially to assist in the automated form imprinting process, particularly in large institutional settings. Thus, the AFI Farrington machine (Model 45 Data Recorder, Data Card Corporation, Minneapolis, Minn.), the Pitney Bowes machine (Model 6700 Electric Plastic. Card Imprinter, Pitney Bowes, Stamford, Conn.) and the National Business Systems machine (Model NBS 306, National Business Systems, Moonachie, N.J.) are examples of the most commonly used products for this purpose in hospitals. The latter two machine styles are very similar to each other. The general structure of all of the machines comprises a flat area (platen) on which to place the cards and forms, and a cover containing a roller mechanism that moves over the form on the card when the cover is lowered on top of the flat area. The problem that exists with these machines is that there is no quick, easy and accurate way to align the various forms over the appropriate place on the embossed card before closing the cover.

To solve this problem, a number of makeshift and temporary measures are sometimes taken by those either responsible for use of the machines or trying to increase machine sales. Colored tape may be placed on the surface upon which the cards and forms are placed to indicate where the corners and edges of the cards and forms are to be placed. This requires careful visual alignment of the corners and edges with the tape. Furthermore, the cards may be moved out of place by the action of placing the forms over them and the forms may be moved out of the proper position by the action of shutting the cover of the machine or by the action of the imprinting roller of the machine. Plastic clips designed to hold the smaller cards in place may also be installed on the surface of the machine, but this does not assist in placement of the forms over the cards.

Another suboptimal solution is the placement of a compressible substance, such as weather-stripping, to mark the appropriate locations. Although this alleviates the problem of placing the forms and cards in the appropriate place, the compressible substance often does not compress sufficiently when the machine cover is brought down resulting in lightly or incompletely imprinted forms because the roller does not produce sufficient pressure on the forms.

Either of these prior solutions also requires that the machines must be retrofitted by addition of the tape or compressible substance after a careful, time-consuming determination of where on the platen to place the particular size and type of cards to be used with that machine.

Although it is standard to have the area for embossing the various forms located in a particular portion of the form such as the upper right corner, the location of other information on the forms very near to the area to be imprinted and the difficulty of accurately placing the appropriate area of the form over the correct area of the card due to the various locations of embossing of the cards and the various sizes of cards, often results in imprinting misplacement. In addition to causing a disorderly appearance of the imprinted form, such misplacement may have more serious consequences. Thus, in the hospital setting, misplacement of the imprinting on a laboratory test result form may make the results unreadable and necessitate repeated tests or lead to inaccurate diagnoses or prescriptions. If the patient name and/or medical record number are unreadable due to imprinting of the information over other printed matter, the wrong patient may be treated or billed depending on the form being used.

The co-pending application Ser. No. 155,216 provides a document and card positioning device for imprinters such as the Data Card Model 45 machine in which the cover evenly depresses card guide corners on the device prior to the imprinting process. The disclosure of this co-pending application is incorporated herein by reference. In summary, the document and card positioning device of the co-pending application comprises a spring-loaded card guide form placed beneath the platen of the imprinting machine. The card guide form has raised corners for positioning of the card and a plurality of pegs protruding upward through the platen for positioning of the form to be imprinted. Depending on the position of imprinting on the forms used on a particular work site, different peg locations on the card guide form may be appropriate. The present invention utilizes the pegs and spring-loaded mechanism of the co-pending application but provides a modified device for use with imprinters of other designs.

Imprinters such as that of Data Card Model 850 Series have rollers that are lowered from the side and roll across the area to be imprinted. Because imprinters such as the Data Card imprinter do not have a cover that is lowered on to the printing area before the roller comes across, when the device disclosed in the co-pending application is used with a Data Card machine, the roller strikes the pegs of the card positioning device from the side of the pegs. This has the potential of causing damage to the roller and/or to the pegs of the device and may also result in a form that is poorly imprinted or not imprinted.

Accordingly, it is an object of the invention to provide a device for easily aligning a variety of forms over the appropriate area of embossed cards of a particular size on an imprinting machine in which machine the cover does not press down upon the printing area before the roller moves across the printing area.

It is another object of the invention to provide a device constructed so that it may be permanently modified to be used to align any one of the most common types of embossed card on an imprinting machine.

It is another object of the invention to provide a device for aligning embossed cards and forms that may be installed easily and quickly on an imprinting machine having a roller mechanism that impinges the imprinting area from the side.

Other objects and advantages of the invention will be more fully apparent from the following disclosure and appended claims.

SUMMARY OF THE INVENTION

In a broad aspect, the invention relates to a card and form alignment device comprising a base piece, an L-shaped piece, a spring mechanism below the base piece, and upward-projecting pegs. The device is preferably constructed so that pegs that are not to be used may be broken off. One preferred embodiment comprises a device with three pegs that with the guide corners on the imprinter serve to align an embossed card of a particular size with the imprinting area of a form.

Other aspects and features of the invention will be more fully apparent from the following disclosure and appended claims.

DETAILED DESCRIPTION OF THE INVENTION AND PREFERRED EMBODIMENTS THEREOF

Figure 1:
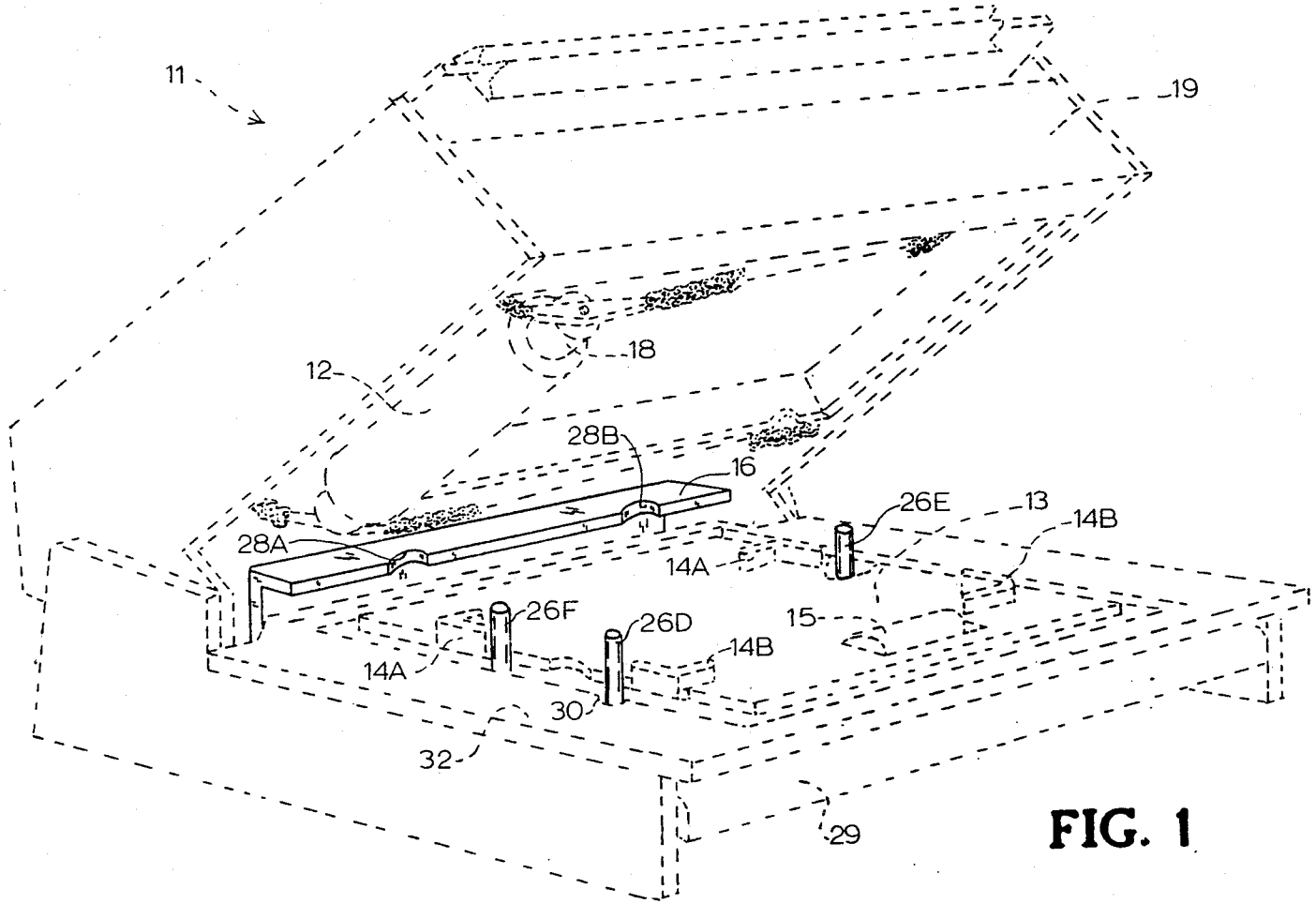
FIG. 1 is a perspective view of a machine upon which the device of the invention is used showing three pegs and the L-shaped piece of the invention.

The preferred embodiment of the device of the present invention may be used on a commercially available imprinting machine 11 having a side roller 12 and which is shown open to receive a card and form in FIG. 1. Using the machine as constructed, an embossed card is placed on the platen 13, within the raised corners 14 of the imprinter. A date-printer 15 is generally present on imprinters.

The preferred embodiment of this invention is designed for use on electric imprinters 11 in which the imprinting roller 12 directly and forcibly impinges on the printing area. These imprinters include the Model 850 Series Datacard Addressograph TM and the Model 90 Electric Imprinter TM of Norcom Electronics Corporation, Norwalk, Conn. In the preferred embodiment, a formed piece, preferably an L-shaped piece 16 is attached to a guide piece 17 and is of a height to allow the roller end piece 18 to hit the L-shaped piece 16 when the cover 19 is lowered.

Figure 2:
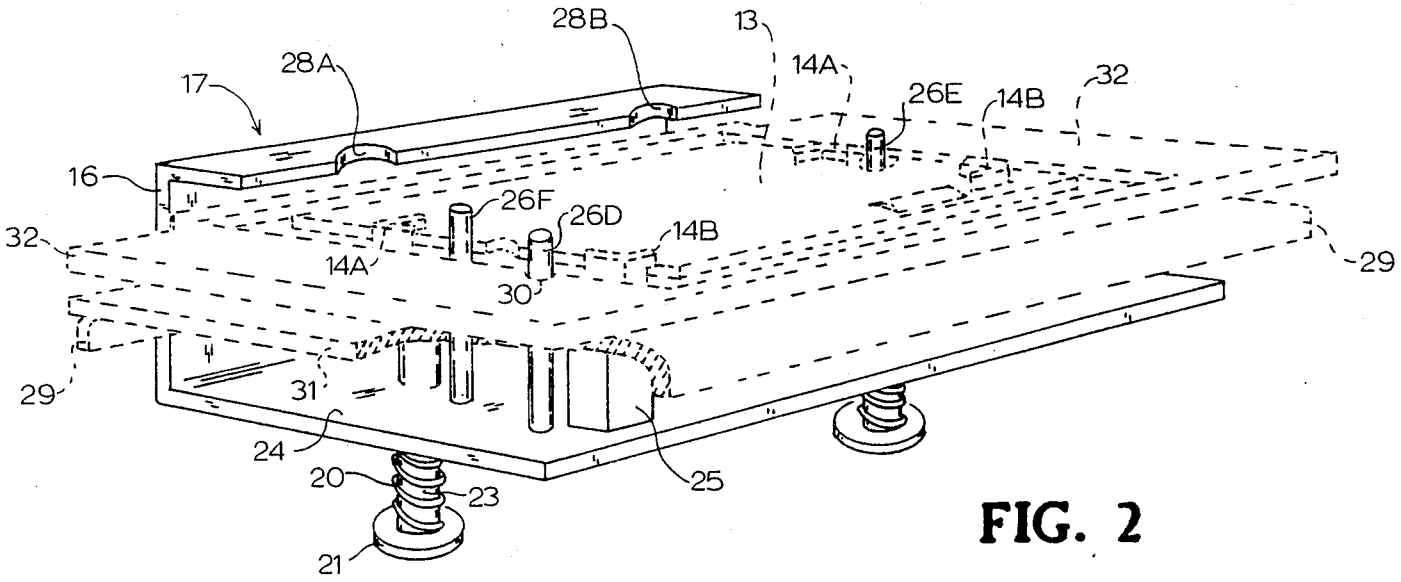
FIG. 2 is a side view of one embodiment of the invention as used on a machine showing the base and the spring of the invention.

For use on the Datacard Addressograph, a useful height H of the L-shaped piece 16 is approximately 2 inches while a useful breadth B of the upper portion of the L-shaped piece 16 in this embodiment is about $\frac{7}{8}$ inch. Variations in imprinter dimensions (height and roller size and position) require adjustment in the dimensions of the L-shaped piece 16. Because these imprinter models, unlike those for which the invention of the co-pending application is designed, do not have springs beneath the platen 13, this invention also comprises springs 20 and washers 21 as shown in FIG. 2. A spring flange (not shown) is preferably associated with each spring as in the prior invention. A screw or rod 23 within each spring 20 extends through the guide piece 17 and is connected to a base 24 of the invention. One or more spacers 25 may be added to keep the guide piece 17 evenly positioned below the platen 13 when the base 24 is not being depressed by the roller 12.

The position and shape of the L-shaped piece 16 keeps the roller 12 from striking the pegs 26A–H when the roller 12 rolls across the area to be imprinted. As the roller 12 is lowered, the end piece 18 of the roller 12 strikes the L-shaped piece 16 at one of the indented areas 28A, B. When the roller 12 is rolling from the left it strikes the indented area 28A on the left side of the L-shaped piece 16, and when the roller rolls from the right, it strikes the right indented area 28B, causing a downward force to be placed on the L-shaped piece 16. The downward force causes the entire guide piece 17 to be forced downward on the springs 20, and the pegs are thus lowered with respect to the platen 13 and out of the way of the roller 12. This avoids any damage to the roller 12 or pegs.

Figure 3:
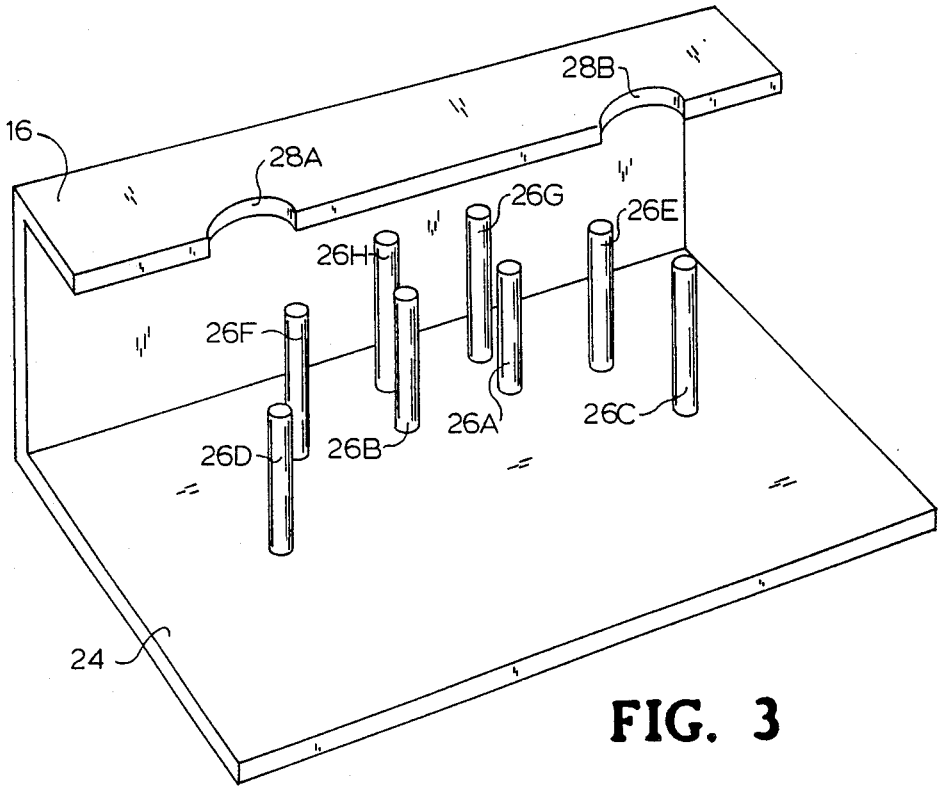
FIG. 3 is a perspective view of the L-shaped guide piece, the base and the eight pegs of the invention as it may be constructed.

The base 24 of the guide piece 17 has mounted thereon a plurality of pegs 26A–H as shown in FIG. 3. The guide piece 17 may comprise up to eight pegs 26A–H as shown in FIG. 3 that are detachable from the base 24, so that pegs that are not to be used on a particular machine (see below) may be detached (e.g. plastic pegs that are broken off or pegs of any material that are unscrewed from the base). Alternatively, different guide pieces 17, each having a particular desired peg arrangement with a lesser number of pegs (preferably 3) may be constructed in a manner analogous to that disclosed in the co-pending application. The pegs 26A–H of this invention must be somewhat longer (approximately 1½ to 2 inches long) than the pegs of the device of the co-pending application, because in this invention the guide piece 17 is placed below the level of the downward flange 29 on the imprinter machine and the pegs must extend from about 1½ inches below the platen to about ⅜ inch or more above the platen. The pegs 26A–H extend upward from the base 24 of the guide piece 17 through holes 30 or openings in the flanged piece 31 that is part of the machine 11 as well as through the platen 13. Because the particular models of the imprinter with which this invention is used have raised guide corners 14 for aligning cards, such guide corners need not be formed on the guide piece 17 of the invention.

Installation of this embodiment on an imprinting machine utilizes existing nuts and bolts on the imprinter machine. The holes 30 for the pegs 26A–H to protrude through must be drilled through the flanged piece 31, and for some peg locations depending on the machine design, holes must be drilled in the plate 32 surrounding the platen 13 to use the guide piece 17 on previously constructed machines of this model. New machines may be manufactured with holes 30 to accommodate some or all of the pegs 26A–H.

The placement of cards and forms using this invention is the same as with the guide of the previous invention. The preferred embodiment of this invention has eight peg locations for detachable pegs 26A–H to allow use of the invention for imprinting on both the right and left sides of forms 34.

Figure 4:
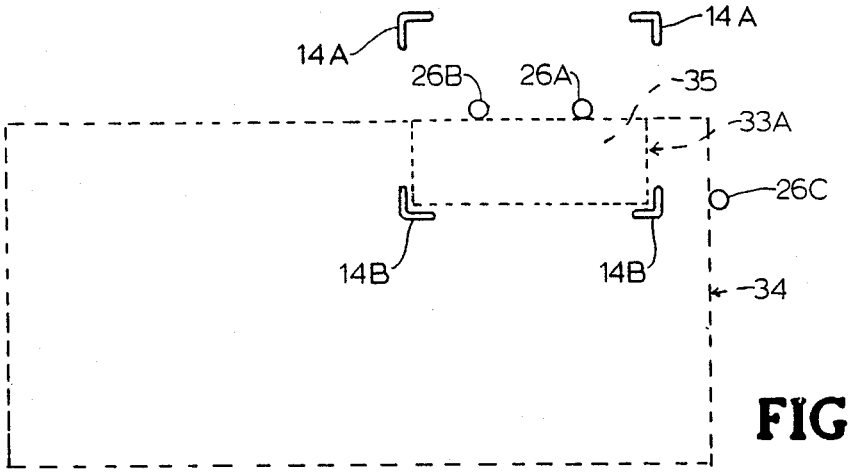
FIG. 4 is a schematic drawing of use of an embodiment of the invention showing alignment of a card and form with central pegs and on outer peg.

The six configurations, in which subsets of the pegs shown in FIG. 3 are preferably used, are as follows:

(1) Use of the two central pegs 26A, B and outer peg 26C and removal of the other pegs (26D–H) allows forms 34 having the typical upper right imprinting area to be properly aligned with a CR 50 card or similar size card 33A. As shown in FIG. 4, the central pegs 26A, B and the lower guide corners 14B form the space for placement of the CR 50 card 33A. The central pegs 26A, B and the outer peg 26C are used to align the upper right hand corner of any form 34 so that the form 34 is in the correct orientation and placement with respect to the CR 50 card 33A.

(2) Use of the two central pegs 26A, B and outer peg 26D, instead of outer peg 26C, allows upper left imprinting of forms with analogous, mirror-image positioning of the card and form as with the first configuration above.

Figure 5:
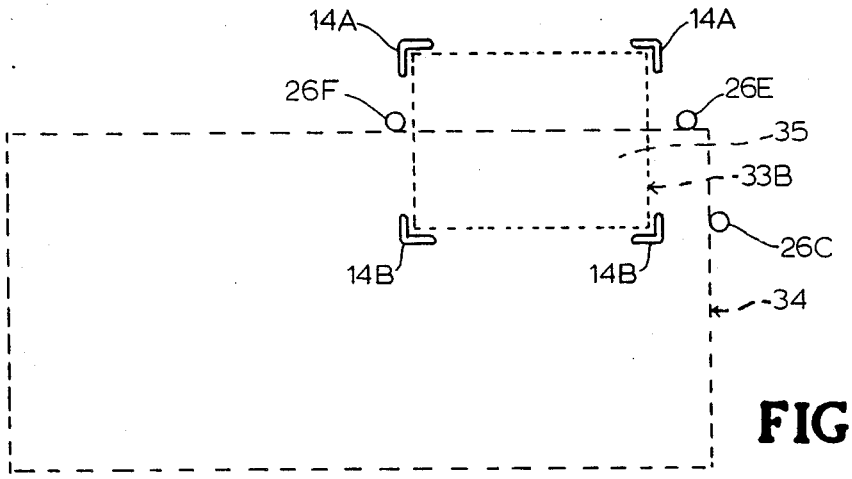
FIG. 5 is a schematic drawing of use of an embodiment of the invention showing alignment of a card and form with side pegs and an outer peg.

(3) Use of two side pegs 26E, F and outer removal of the remaining pegs 26A, B, D, G, H allows forms having the typical upper right imprinting area to be properly aligned with the card imprinted area 35 of the bottom half of a CR 80 card 33B. As shown in FIG. 5, the upper guide corners 14A and the lower guide corners 14B form the space for placement of the CR 80 card 33B. The side pegs 26 E, F and the outer peg 26C are used to align the form 34 so that the bottom half of the CR 80 card 33B is imprinted in the correct space on the form 34.

(4) The fourth configuration is a left side imprinting variation of the third configuration and utilizes outer peg 26D instead of outer peg 26C.

Figure 6:
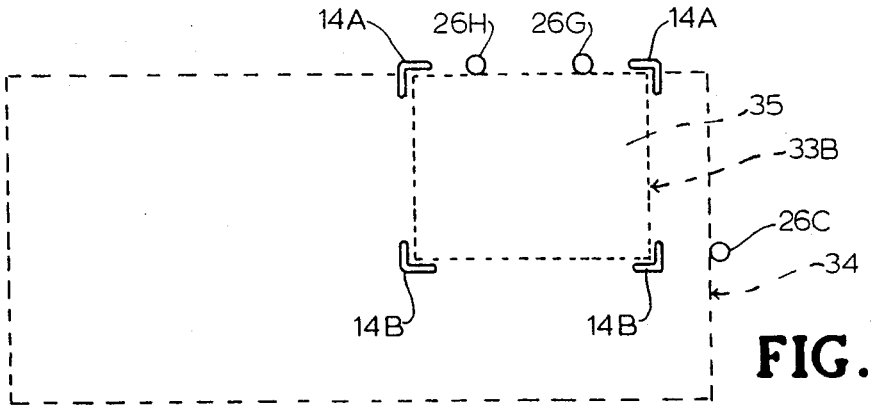
FIG. 6 is a schematic drawing of use of an embodiment of the invention showing alignment of a card and form with upper pegs and an outer peg.

(5) Use of only top pegs 26G, H and outer peg 26C allows the typical forms to be properly aligned with the top half of a CR 80 card 33B. As shown in FIG. 6, the upper guide corners 14A and the lower guide corners 14B again form the space for placement of the card imprinted area 35 of CR 80 card 33B. Unlike the embodiment shown in FIG. 5, top pegs 26G, H, instead of the side pegs 26E, F, along with the outer peg 26C, are used to align the form 34 so that the top half of the CR 80 card 33B is imprinted in the correct space on form 34.

(6) The sixth configuration utilizes the top pegs 26G, H and outer peg 26D instead of outer peg 26C to allow left side form imprinting with analogous card and form positioning to the fifth configuration.

While the invention has been described with reference to specific embodiments thereof, it will be appreciated that numerous variations, modifications, and embodiments are possible, and accordingly, all such variations, modifications, and embodiments are to be regarded as being within the spirit and scope of the invention.

What is claimed is:

1. In a card and document positioning imprinter device including a roller mechanism movable between an inoperative upper position and lowered printing position over a platen supported by a lower frame piece, the improvement comprising:

(a) a base positioned beneath the platen;

(b) a plurality of pegs extending upward from the base;

(c) a depressible spring means for vertically positioning the base beneath the platen so that the pegs extend upward above the platen; and (d) a formed piece connected to the base and extending above the platen so that when the roller mechanism is lowered, said roller mechanism strikes the formed piece, said striking resulting in the base being pushed down on the depressible spring means and the pegs being lowered.

2. The positioning device of claim 1, wherein the pegs that are not to be used may be removed from the base.

3. The positioning device of claim 2, wherein the pegs comprise four pairs of pegs, said pairs of pegs comprising two outer pegs, two upper pegs, two side pegs and two central pegs, said pegs positioned so that selective removal of two pairs of pegs and one outer peg results in a remaining peg arrangement useful for aligning a particular size of card with an imprinting area of a form.

4. The positioning device of claim 3, wherein the remaining pegs are an outer peg and the two central pegs and the device is useful for aligning a CR 50 size card with a form.

5. The positioning device of claim 3, wherein the remaining pegs are an outer peg and the two side pegs and the device is useful for aligning the bottom of a CR 80 size card with a form.

6. The positioning device of claim 3, wherein the remaining pegs are an outer peg and two upper pegs and the device is useful for aligning the top of a CR 80 size card with a form.

7. The positioning device of claim 1, wherein the device comprises three pegs.

8. The positioning device of claim 7, wherein the pegs comprise an outer peg and two central pegs, and the device is useful for aligning a CR 50 size card with the imprinting area of a form.

9. The positioning device of claim 7, wherein the pegs comprise an outer peg and two side pegs and the device is useful for aligning the bottom of a CR 80 size card with the imprinting area of a form.

10. The positioning device of claim 7, wherein the pegs comprise an outer peg and two upper pegs, and the device is useful for aligning the top of a CR 80 size card with the imprinting area of a form.

* * * * *